US010409184B2

(12) United States Patent
Nakajima et al.

(10) Patent No.: US 10,409,184 B2
(45) Date of Patent: Sep. 10, 2019

(54) ELECTROSTATIC CHARGE IMAGE DEVELOPING TONER COMPRISING ACICULAR TITANIUM OXIDE

(71) Applicant: Konica Minolta, Inc., Tokyo (JP)

(72) Inventors: Kazuhiko Nakajima, Tama (JP); Miyuki Yamada, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/690,464

(22) Filed: Aug. 30, 2017

(65) Prior Publication Data

US 2018/0074422 A1 Mar. 15, 2018

(30) Foreign Application Priority Data

Sep. 9, 2016 (JP) ..... 2016-176114

(51) Int. Cl.
*G03G 9/09* (2006.01)
*G03G 9/08* (2006.01)
*G03G 9/097* (2006.01)

(52) U.S. Cl.
CPC ..... *G03G 9/0926* (2013.01); *G03G 9/0821* (2013.01); *G03G 9/09708* (2013.01)

(58) Field of Classification Search
USPC ..... 430/108.6, 111.4, 124.4; 428/402; 423/610
See application file for complete search history.

(56) References Cited

U.S. PATENT DOCUMENTS 5,429,902 A * 7/1995 Saito ..... C09C 1/3684 430/108.3
2003/0224274 A1* 12/2003 Horikoshi ..... G03G 9/09708 430/108.6
2004/0137349 A1* 7/2004 Horikoshi ..... G03G 9/09 430/108.6
2015/0160576 A1* 6/2015 Sugahara ..... G03G 9/09328 430/108.6

FOREIGN PATENT DOCUMENTS

JP 2012053153 A 3/2012

OTHER PUBLICATIONS

Potrolniczak et al., Titanium dioxide high aspect ratio nanoparticle hydrothermal synthesis optimization, Open Chem., 2015; 13:75-81.*

* cited by examiner

*Primary Examiner* — Hoa (Holly) Le
(74) *Attorney, Agent, or Firm* — Lucas & Mercanti, LLP

(57) ABSTRACT

An electrostatic charge image developing toner includes a white pigment being acicular titanium oxide having an average aspect ratio within a range of 3 to 30.

20 Claims, 1 Drawing Sheet

ELECTROSTATIC CHARGE IMAGE DEVELOPING TONER COMPRISING ACICULAR TITANIUM OXIDE

CROSS-REFERENCE TO RELATED APPLICATIONS

Japanese Patent Application No. 2016-176114 filed on Sep. 9, 2016 including the description, claims, drawings, and abstract the entire disclosure is incorporated by reference in its entirety.

BACKGROUND

Technological Field

The present invention relates to an electrostatic charge image developing toner, in particular, a white electrostatic charge image developing toner that has high masking effects when the white toner is overlaid on a color ground.

Description of the Related Art

Electrophotography has been increasingly employed in package print in various markets. A requirement for white toner is high masking effects (ability of development of clear white color not affected by the underlying color) when the white toner is overlaid on an underling color ground.

A common white pigment used in white toner is titanium oxide. Although a toner containing a high content of titanium oxide for unit toner resin is known to have high masking effects, addition of excess amount of titanium oxide is also well known to decrease the electric chargeability of the toner. The loadable amount of common titanium oxide (so-called spherical titanium oxide) accordingly has an upper limit. For example, Japanese Patent Application Laid-Open Publication No. 2012-053153 discloses a toner containing a binder resin and common spherical titanium oxide. Unfortunately, this toner cannot have still insufficient masking effects.

SUMMARY

An object of the present invention, which has been accomplished to solve the problem described above, is to provide a white electrostatic charge image developing toner that has high masking effects when the white toner is overlaid on a color ground.

The present inventors have examined the causes of the above mentioned problems in order to solve the above problems and arrived at the present invention on the basis of the finding that an electrostatic charge image developing toner has high masking effects when the white toner is overlaid on a color ground by including a white pigment being acicular titanium oxide having an average aspect ratio within a specific range.

To achieve at least one of the above-mentioned objects, according to an aspect of the present invention, an electrostatic charge image developing toner includes a white pigment being acicular titanium oxide having an average aspect ratio within a range of 3 to 30.

BRIEF DESCRIPTION OF THE DRAWING

The advantages and features provided by one or more embodiments of the invention will become more fully understand from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The means described above according to the present invention provides a white electrostatic image developing toner that has high masking effects when the white toner is overlaid on a color ground.

Although the expression mechanism or action mechanism of the advantageous effects is not clarified, the inventors have formulated the following presumption:

The toner containing acicular titanium oxide barely generates gaps between the toner particles and thus can effectively mask an underlying color ground, resulting in a high covering rate per unit weight on the sheet. As a result, this toner has higher masking effects than that of spherical titanium oxide at equal amounts (parts by weight or density).

Figure 1A:
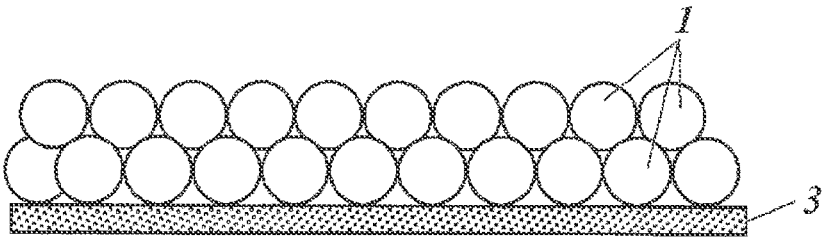
FIG. 1A to FIG. 1D include schematic diagrams of supports covered with particles having the same volume.
Figure 1B:
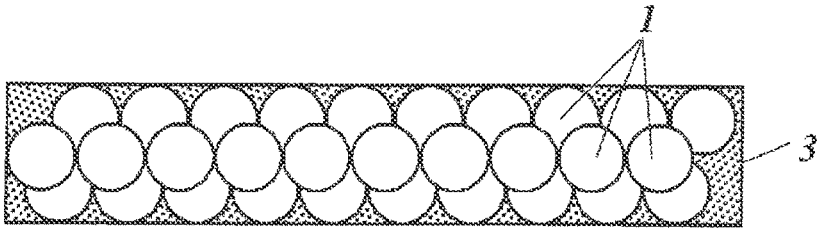
Figure 1C:
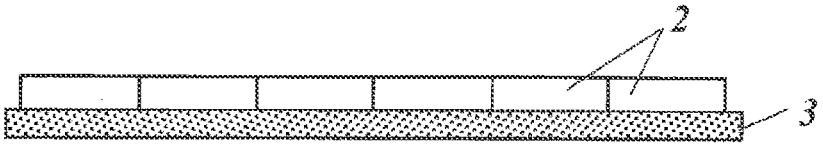
Figure 1D:
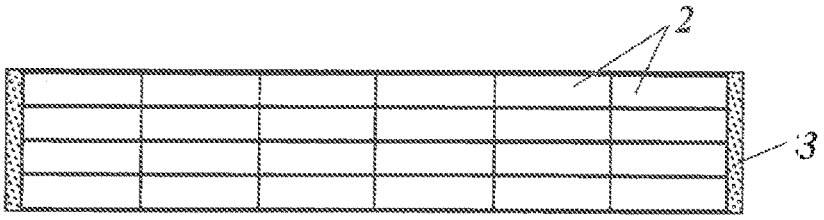

Titanium oxide having an average aspect ratio of 3 to 30 leads to high masking effects of the ground at equal amounts. This phenomenon will now be explained with reference to FIG. 1. FIG. 1 includes schematic diagrams of supports covered with particles having the same volume. FIG. 1A is a schematic side view of spherical particles 1; FIG. 1B is a schematic top view of the particles 1; FIG. 10 is a schematic side view of acicular particles 2 having an average aspect ratio of 3; and FIG. 1D is a schematic top view of the acicular particles 2 having an average aspect ratio of 3. In the case that particles are oriented parallel to the plane of the support 3 or paper, 30 spherical particles 1 are necessary for completely covering the support 3 as shown in FIGS. 1A and 1B, whereas only 24 particles 2 having an average aspect ratio of 3 are necessary for completely covering the support 3 as shown in FIGS. 1C and 1D. Thus, a smaller number of acicular particles 2 having an average aspect ratio of 3 can completely cover the substrate compared to spherical particles 1. In conclusion, acicular particles 2 having an average aspect ratio of 3 in smaller parts by weight have high masking effects of the ground.

The electrostatic charge image developing toner of the present invention contains a white pigment of acicular titanium oxide particles having an average aspect ratio in the range of 3 to 30. Such a concept is a technical feature common to the claimed inventions.

In some preferred embodiments of the present invention, the acicular titanium oxide particles has a number average major axis diameter within a range of 1 to 7 μm for facilitating expression of the advantageous effects.

The content of the acicular titanium oxide particles having an average aspect ratio in the range of 3 to 30 is preferably within the range of 5 to 100 mass % of the total titanium oxide content for achieving high masking effects.

The acicular titanium oxide particles preferably have a BET specific surface area in the range of 3 to 50 $m^2/g$ for achieving high masking effects.

The acicular titanium oxide preferably has a rutile crystal structures for achieving high masking effects.

The present invention and its constituent and embodiments for achieving the present invention will now be described in detail. Throughout the specification, "to"

between two numerical values indicates that the lower limit includes the numeric value before "to" and that the upper limit includes the numeric value after "to".

[Electrostatic Charge Image Developing Toner]

<Acicular Titanium Oxide Particle>

The electrostatic charge image developing toner of the present invention contains a white pigment of acicular titanium oxide particles having an average aspect ratio in the range of 3 to 30. The average aspect ratio is within the range of preferably 8 to 25, more preferably 11 to 20.

The average aspect ratio in the present invention refers to the average aspect ratio (=(number average major axis diameter)/(number average minor axis diameter)) that is calculated from the ratio of the number average major axis diameter to the number average minor axis diameter.

The "major axis diameter" of the acicular titanium oxide particles refers to the highest length or maximum major axis diameter of each acicular titanium oxide particle in a photographic image captured at a magnification of 2000 with a scanning electron microscope(SEM), such as JSM-7401F (by JEOL). The "short axis diameter" refers to a diameter perpendicular to the major axis and crossing the major axis at the middle point.

The number average major axis diameter, the number average minor axis diameter, and the average aspect ratio in the present invention can be calculated from binary data of 30 particles selected at random in the photographic image with an image analyzer LUZEX® AP made by NIRECO CORPORATION.

The average particle ratio is calculated from 30 titanium oxide particles.

The acicular titanium oxide particles of the present invention have a number average major axis diameter in the range of preferably 1 to 7 μm, more preferably 2 to 4 μm in view of masking effects.

The number average minor axis diameter is within the range of preferably 0.001 to 1 μm, more preferably 0.01 to 0.3 μm in view of masking effects.

The acicular titanium oxide particles of the present invention preferably have a sphere equivalent grain diameter in the range of 0.1 to 1.0 in view of masking effects. The particles within this range can maintain light diffusion in a visible light region without visual transparency.

The content of the acicular titanium oxide particles having an average aspect ratio in the range of 3 to 30 is within the range of desirably 5 to 100 mass %, preferably 30 to 100 mass %, more preferably 55 to 100 mass % of the total titanium oxide content for achieving high masking effects.

The total titanium oxide content refers to titanium oxide present in the form of white pigment and does not contain titanium oxide as an external additive.

The content of the acicular titanium oxide particles having an average aspect ratio in the range of 3 to 30 in the present invention is within the range of preferably 10 to 40 mass %, more preferably 20 to 30 mass % of the toner. It should be noted that the toner refers to aggregation of toner matrix particles before addition of external additive (also referred to as toner not containing external additive) and the content of the acicular titanium oxide particles having an average aspect ratio in the range of 3 to 30 is a relative value to the mass (100 mass %) of the toner matrix particles.

The acicular titanium oxide particles have a BET specific surface area in the range of preferably 3 to 50 $m^2/g$, more preferably 8 to 30 $m^2/g$ for achieving high masking effects.

The BET specific surface area in the present invention is determined with a surface area analyzer "GEMINI 2390" (SHIMADZU Corporation). In detail, a sample is placed into an analytical cell (25 mL), is accurately weighed with a microbalance, and then is subjected to vacuum suction heat treatment at 200° C. for 60 minutes in a gas port provided in the analyzer. The sample is placed into an analytical port and is subjected to measurement by a ten point mode. After the measurement, the mass of the sample is inputted to automatically calculate the BET specific surface area. The cell used for the measurement has a spherical outer diameter of 1.9 cm (0.75 inch), a length of 3.8 cm (1.5 inches), a cell length of 15.5 cm (6.1 inches), a volume of 12.0 $cm^3$, and a sample volume of about 6.00 $cm^3$. The sample is measured under an environment at a temperature of 20° C., a relative humidity of 50%, and no condensation.

The crystal structure of the acicular titanium oxide of the present invention may be of a rutile or anatase type. The rutile type, which has a higher refractive index, is preferred to the anatase type in view of masking effects and color conditioning of the toner.

The electrostatic charge image developing toner of the present invention at least contains acicular titanium oxide particles as a white pigment, a binder resin, and toner matrix particles containing a release agent and may further contain a charge control agent and/or external additive, if necessary.

In the present invention, toner matrix particles containing an external additive is referred to as toner particles, and aggregates of the toner particles are referred to as toner. Although the toner matrix particles can generally be used without any treatment, the toner particles in the present invention are toner matrix particles containing any external additive.

<Toner Matrix Particles>

The toner matrix particles of the present invention may be any known one containing the white pigment described above, and preferably contains a binder resin. Preferably the binder resin contains a crystalline resin.

The toner matrix particles of the present invention may further contain any known white colorant besides the white pigment (titanium oxide). Examples of the known white colorant include inorganic pigments, such as heavy calcium carbonate, light calcium carbonate, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate salt, cericite, bentonite, and smectite; and organic pigments, such as polystyrene resin particles and urea-formalin resin particles. Further examples include hollow pigments, such as hollow resin particles and hollow silica.

<Binder Resin>

In the case that the toner matrix particles are prepared by, for example, pulverization, dissolution suspension, or emulsion aggregation, examples of the binder resin contained in the toner matrix particles of the present invention include known resins, such as styrene resins, (meth)acrylic resins, styrene-(meth)acrylic copolymeric resins, vinyl resins such as olefinic resins, polyester resins, polyamide resins, carbonate resins, polyethers, poly(vinyl acetate) resins, polysulfons, epoxy resins, polyurethane resins, and urea resins. These resins may be used alone or in combination. Vinyl resins are preferred in the present invention in view of electrical conductivity of the toner.

<Crystalline Resin)

The binder resin in the toner matrix particles preferably contains a crystalline resin to facilitate melting of the toner particles and to reduce energy consumption during fixing of the toner onto a recording medium. Examples of the crystalline resin include crystalline polyester resins and crystalline vinyl resins. Particularly preferred are crystalline polyester resins, more preferably crystalline aliphatic polyester resins.

The crystalline polyester resin can be produced by a common polyester polymerization process involving a reaction of an acid component with an alcohol component. Examples of the polymerization process include direct polycondensation and ester exchange. The polymerization process in the present invention can be appropriately determined depending on, for example, the types of the monomers.

The crystalline polyester resin may be produced at a polymerization temperature of, for example, 180 to 230° C. The reaction system may be evacuated to remove water and alcohol generated during condensation of the monomers, if necessary. If the monomers are undissolved or immiscible at the reaction temperature, a solvent having a high boiling point as a solubilizing agent may be added to facilitate dissolution of the monomer. The polycondensation reaction is carried out while the solubilizing agent is being removed. If any monomer with low miscibility is present in the copolymerization reaction, it is preferred that the monomer with low miscibility and acid or alcohol to be polycondensed to the monomer are preliminarily condensed and then the product is polycondensed with the main component.

The binder resin may further contain any other resin, for example, styrene-(meth)acrylic resin and polyester resin, and partially modified polyester resin.

The styrene-(meth)acrylic resin has a molecular structure of a radical polymer of a compound having a radically polymerizable unsaturated bond and can be synthesized by, for example, radical polymerization of this compound. Such compounds may be used alone or in combination. Examples of the compound include styrene and its derivatives and (meth)acrylic acid and its derivatives.

Examples of the styrene and its derivatives include styrene, o-methylstyrene, m-methylstyrene, p-methylstyrene, p-methoxystyrene, p-phenylstyrene, p-chlorostyrene, p-ethyl styrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meth)acrylic acid and its derivatives include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxy ethyl acrylate, γ-aminopropyl acrylate, stearyl methacrylate, dimethylaminoethyl methacrylate, and diethylaminoethyl methacrylate.

The polyester has a molecular structure of a condensation polymerization product of a polyvalent carboxylic acid and a polyhydric alcohol, and can be synthesized by, for example, condensation polymerization of these monomers.

Such polyvalent carboxylic acids may be used alone or in combination. Examples of the polyvalent carboxylic acid include aliphatic dicarboxylic acids, aromatic dicarboxylic acids, dicarboxylic acids with double bonds, trivalent or higher-valent carboxylic acids, anhydrides thereof, and lower alkyl esters thereof. The dicarboxylic acids with double bonds, which are radically crosslinkable by double bonds, are preferred in view of prevention of hot offset at the fixing of the toner particles.

Examples of the aliphatic dicarboxylic acid include oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecandicarboxylic acid, and 1,18-octadecanedicarboxylic acid.

Examples of the aromatic dicarboxylic acid include phthalic acid, isophthalic acid, terephthalic acid, naphthalen-2,6-dicarboxylic acid, malonic acid, and mesaconic acid.

Examples of dicarboxylic acids with double bonds include maleic acid, fumaric acid, 3-hexendioic acid, and 3-octendioic acid. Among these preferred are fumaric acid and maleic acid in view of material cost.

Examples of the trivalent or higher-valent carboxylic acid include 1,2,4-benzenetricarboxylic acid, 1,2,5-benzenetricarboxylic acid, and 1,2,4-naphthalenetricarboxylic acid.

These polyhydric alcohols may be used alone or in combination. Examples of the polyhydric alcohols include aliphatic diols and trivalent or higher-valent alcohols. Among these preferred are aliphatic diols that can readily produce crystalline polyester resins (described below). Particularly preferred are linear chain aliphatic diols having main chains consisting of 7 to 20 carbon atoms.

The linear chain aliphatic diols contribute to stable crystallinity of the polyester, and thus the polyester can have a proper melting point. The resulting polyester can produce two-component developers that have high toner blocking resistance, high image retention, and low temperature fixing ability. The linear chain aliphatic diols having main chains consisting of 7 to 20 carbon atoms can produce a condensation polymerization product with an aromatic dicarboxylic acid suitable for low-temperature fixing. In addition, these materials can be readily available. In this regard, the number of carbon atoms of the main chain is more preferably 7 to 14.

Preferred examples of the aliphatic diols used for synthesis of the crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these preferred are 1,8-octanediol, 1,9-nonanediol, or 1,10-decanediol, which can be readily available.

Examples of trivalent or higher-valent alcohols include glycerin, trimethylolethane, trimethylolpropane, and pentaerythritol.

A chain transfer agent may be added to the monomer component for synthesis of the binder resin for adjusting the molecular weight of the resin. The chain transfer agents may be used alone or in combination in proper amounts within the advantageous effects of the embodiment. Examples of the chain transfer agents include 2-chloroethanol; mercaptans, such as octylmercaptan, dodecylmercaptan, and t-dodecylmercaptan; and styrene dimers.

<Release Agent>

The release agent may be any known wax.

Examples of the wax include polyolefin waxes, such as polyethylene wax and polypropylene wax; branched hydrocarbon waxes, such as a microcrystalline wax; long-chain hydrocarbon waxes, such as paraffin wax and Sasol wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerin tribehenate, glycerol tribehenate, 1,18-octadecanediol distearate, tristearyl trimellitate, and distearyl maleate; and amide waxes, such as ethylenediamine behenylamide, and trimellitic acid tristearylamide.

The content of the release agent is within the range of preferably 0.1 to 30 parts by mass, more preferably 1 to 10 parts by mass for 100 parts by mass of binder resin.

<Charge Control Agent>

Any charge control agent that can generate positive or negative electric charge by frictional electrification may be used, for example, known positive-charge controlling agents and negative-charge controlling agents.

The content of the charge control agent is within the range of preferably 0.01 to 30 parts by mass, more preferably 0.1 to 10 parts by mass for 100 parts by mass of binder resin.

<External Additive>

In order to improve chargeability, flow ability, cleaning ability of the toner, known organic and inorganic nanoparticles and/or lubricants as external additives may be added to the surface of the toner matrix particles.

Examples of preferred inorganic nanoparticles usable as external additives include nanoparticles containing silica, titania, alumina, or strontium titanate. The nanoparticles may preliminarily undergo hydrophobic treatment.

The usable organic nanoparticles have a spherical shape having a number average primary particle diameter of about 10 to about 2000 nm. Examples of usable nanoparticles include homopolymers and copolymers of, for example, styrene and methyl methacrylate.

The lubricants are used for further improving cleaning ability and transfer characteristics of the toner. Examples of the lubricant include metal salts of higher fatty acids, such as zinc, aluminum, copper, magnesium, and calcium salts of stearic acid; zinc, manganese, iron, copper, and magnesium salts of oleic acid; zinc, copper, magnesium, and calcium salts of palmitic acid; zinc and calcium salts of linoleic acid; and zinc and calcium salts of ricinoleic acid. These external additives may be used in combination.

The external additives may be added with any known mixing machine, for example, a turbular mixer, a Henschel mixer, a Nauta mixer, or a V-shaped mixer.

[Preparation of Electrostatic Charge Image Developing Toner]

The electrostatic charge image developing toner of the present invention may be prepared by any method. Examples of such a method include pulverization, emulsion polymerization and coagulation, and emulsion aggregation.

The emulsion polymerization coagulation process involves mixing dispersion of nanoparticles of a binder resin (hereinafter, also referred to as binder resin nanoparticles) produced by emulsion polymerization with dispersion of nanoparticles of a colorant (hereinafter, also referred to as colorant nanoparticles) and dispersion of a release agent such as wax, coagulating the mixture into toner particles having a desirable particle size, and controlling the shape of the toner nanoparticles through fusion of the surfaces of the binder resin nanoparticles to produce toner particles.

The emulsion aggregation process involves dropwise adding a solution of a binder resin in solvent into a poor solvent to prepare resin particle dispersion, mixing the resin particle dispersion with colorant dispersion and dispersion of a release agent, such as wax, aggregating the particles into a desirable toner particle diameter, and controlling the shape of the toner nanoparticles through fusion of the surfaces of the binder resin nanoparticle to produce toner particles.

A typical process of producing the toner of the present invention by emulsion polymerization coagulation involves the following steps:

(1) preparing a dispersion of colorant nanoparticles in an aqueous medium;

(2) preparing a dispersion of binder resin nanoparticles and an optional internal additive in an aqueous medium;

(3) preparing a dispersion of binder resin nanoparticles by emulsion polymerization;

(4) mixing the dispersion of colorant nanoparticles with the dispersion of binder resin nanoparticles to allow the colorant nanoparticles and the binder resin nanoparticles to be coagulated, aggregated, and fused into toner matrix particles;

(5) filtering the aqueous dispersion of toner matrix particles to separate toner matrix particles from, for example, surfactant;

(6) drying the toner matrix particles; and (7) adding an external additive to the toner matrix particles.

In the case of production of toner by emulsion polymerization coagulation, the resulting binder resin nanoparticles may have a multilayer structure consisting of two or more layers composed of binder resins having different compositions. For example, resin nanoparticles having a double-layer structure can be produced by preparation of a dispersion of resin particles by usual emulsion polymerization (first stage polymerization), addition of a polymerization initiator and a polymerizable monomer to the dispersion, and polymerization of this system (second stage polymerization).

Some emulsion polymerization coagulation processes can produce toner particles having a core-shell structure. In detail, core particles are prepared by coagulation, aggregation, and fusion of binder resin nanoparticles for core particles and nanoparticles for colorant, addition of binder resin nanoparticles for a shell layer to a dispersion of core particles, and aggregation and fusion of the binder resin nanoparticles for the shell layer onto the surfaces of the core particles to form a shell layer covering the surface of the core particles. Toner particles having a core-shell structure can thereby be produced.

A typical process of producing the toner of the present invention by pulverization involves the following steps:

(1) mixing a binder resin, a colorant, and an optional internal additive with, for example, a Henschel mixer;

(2) heating and kneading the resulting mixture with, for example, an extruder;

(3) preliminarily pulverizing the kneaded product with, for example, a hammer-mill and then pulverizing the product with, for example, a turbo mill;

(4) classifying the pulverized product with an air classifier using the Coanda effect into toner matrix particles; and (5) adding an external additive to the toner matrix particles.

<Particle Size of Toner>

The particle size of the toner of the present invention has a median diameter on the basis of volume within the range of preferably 4 to 12 μm, more preferably 5 to 9 μm.

A volume-based median diameter within the range contributes to high transcription efficiency of the toner, resulting in improvements in half tone image quality and image quality of thin lines and dots.

The median diameter of the toner particles is determined with an analyzer "Multisizer 3" (Beckman Coulter, Inc.) connected with a computer system (Beckman Coulter, Inc.).

In detail, toner (0.02 g) is added to a surfactant solution (20 mL) (for example, a solution of neutral detergent that contains a surfactant component and is diluted with pure water to ten folds) to wet the toner, the solution is ultrasonicated for one minutes to prepare a toner particle dispersion, and the toner particle dispersion is injected into a beaker containing "ISOTON® II diluent" (Beckman Coulter, Inc.) in a sample stand of the analyzer with a pipette until the displayed concentration of the analyzer reaches 5 to 10%. Such a range of concentration can achieve measurement with high reproducibility. In the analyzer, 25000 particles are counted at an aperture diameter of 50 μm, the range of 1 to 30 μm is divided into 256 subranges, and the number of particles in each subrange is determined. Among the volume-based distribution, the 50% particle size from the maximum subranges is defined as a median diameter.

The toner particles preferably have an aspect ratio of 0.8 to 0.99.

[Two-component Developer for Electrostatic Latent Image]

Although the electrostatic charge image developing toner of the present invention can be used in the form of non-magnetic one-component developer, it is suitable for two-component developer containing a carrier for developing electrostatic latent images.

<Carrier>

The carrier particles are composed of a magnetic substance. The carrier particles are categorized into a cover type that consists of magnetic core particles covered with skin layers and a resin dispersion type that consists of magnetic nanoparticles dispersed in a resin. A cover type is preferred that barely adheres on photoreceptor.

<Carrier Core Particle>

Core particles are composed of a magnetic substance that is strongly magnetized in the magnetic field. The magnetic substance may be composed of one component or two or more component. Examples of the magnetic substance include ferromagnetic metals, such as iron, nickel and cobalt; alloys and compounds containing these metals; and alloys representing ferromagnetism by heat treatment.

Examples of the ferromagnetic metals and compounds containing the metals include iron, ferrite represented by Formula (a), and magnetite represented by Formula (b):

$$MO.Fe_2O_3 \qquad \text{Formula (a)}$$

$$MFe_2O_4 \qquad \text{Formula (b)}$$

where M in Formulae (a) and (b) is at least one monovalent or divalent metal selected from the group consisting of Mn, Fe, Ni, Co, Cu, Mg, Zn, Cd, and Li.

Examples of the alloy representing ferromagnetism by heat treatment include Heusler alloys, such as manganese-copper-aluminum and manganese-copper-tin, and chromium dioxide.

Preferably the core particles are composed of a variety of ferrites. Since the specific gravity of the carrier particles of a cover type is smaller than the specific gravity of the metal of the core particles, the impact force generated during agitation in the developing vessel can be reduced.

<Carrier Coat Resin (Cover Material)>

The cover material may be composed of a single component or two or more components. The cover material may be composed of any known resin used for coating of carrier core particles. The cover material is preferably composed of a resin having cycloaklyl groups that can reduce the moisture absorption of the carrier particles and enhance adhesion to the core particles of the cover layer. Examples of the cycloalkyl group include cyclohexyl, cyclopentyl, cyclopropyl, cyclobutyl, cycloheptyl, cyclooctyl, cyclononyl, and cyclodecyl groups. Among these, preferred are cyclohexyl and cyclopentyl groups, more preferred is a cyclohexyl group in view of adhesion to ferrite particles. The resin has a weight-average molecular weight Mw of, for example, preferably 10000 to 800000, more preferably 100000 to 750000. The content of the cycloalkyl groups in the resin is, for example, 10 to 90 mass %. The content of the cycloalkyl groups in the resin can be determined by, for example, pyrolysis gas chromatography/mass spectroscopy (P-GC/MS) and $^1$H-NMR.

<Two-component Developer>

The two-component developer can be produced by mixing toner particles and carrier particles appropriately such that the content of the toner particles (toner density) becomes 4.0 to 8.0 mass %.

Examples of the mixer used in this process include a Nauta mixer, a W cone mixer and a V-type mixer.

[Formation of Image]

The electrostatic charge image developing toner of the present invention can be suitably used in image formation in common electrophotographic systems.

The above-mentioned embodiments should not be construed to limit the present invention and may be appropriately modified within the scope of the present invention.

EXAMPLES

The present invention will now be described in more detail by ways of Examples, which should not be construed to limit the present invention. In Examples, "part(s)" and "%" indicate "part(s) by mass" and "mass %", respectively, unless otherwise stated. Each operation was carried out at room temperature (25° C.).

[Preparation of Titanium Oxide 1 to Titanium Oxide 5]

Titanium oxide ET-500W, FT-1000, FT-2000, FT-3000, and TTO-S-2 (available from ISHIHARA SANGYO KAISHA, LTD.) were prepared as titanium oxide 1 to titanium oxide 5.

[Preparation of Titanium Oxide 6 to Titanium Oxide 9]

Titanium oxide 6 to titanium oxide 9 were prepared with reference to a method of producing acicular titanium oxide described in Japanese Patent Application Laid-Open Publication No. hei7-2598.

(1) Aqueous titanium tetrachloride solution having a $TiO_2$ concentration of 207.9 g/L in an amount of 462.5 g on a $TiO_2$ mass basis is placed into a 5-L four-necked flask and heated to 75° C. with stirring. A slurry of rutile seed crystal in an amount of 37.5 g on a $TiO_2$ mass basis was then added and the reactant was hydrolyzed at 75° C. for 2 hours into a slurry (2941 mL, a dioxide $TiO_2$ concentration: 163.2 g/L) of rutile crystalline titanium.

(2) Fractions (500 mL) of the slurry prepared in step (1) were each placed into a 1-L beaker, and $Na_2CO_3$ powder was added with stirring to neutralize the pH of the slurry such that titanium oxide 6 to titanium oxide 9 each have an optimized number average major axis diameter and an optimized number average minor axis diameter shown in Table 1. $Na_4P_2O_7$ powder (30 parts by mass for 100 parts by mass of $TiO_2$) was added to each reaction system, and the slurry was thoroughly mixed. The slurry was filtrated and the residue was dehydrated into cake. The cake was calcined at 870° C. for 3 hours in a muffle furnace. The calcined product was placed into deionized water and was mixed for about 10 minutes with a mixer, and the slurry was filtered, washed to remove soluble salt, and was dried into titanium oxide 6 to 9.

[Preparation of Toner 1]

<Synthesis of Amorphous Resin 1>

Terephthalic acid (TPA) (90 parts by mass), trimellitic acid (TMA) (6 parts by mass), fumaric acid (FA) (19 parts by mass), dodecenylsuccinic acid anhydride (DDSA) (85 parts by mass), Bisphenol A propylene oxide adduct (BPA·PO) (351 parts by mass), and Bisphenol A ethylene oxide adduct (BPA·EO) (58 parts by mass) were placed in a reaction vessel equipped with an agitator, a thermometer, a condenser and a nitrogen gas inlet, and the reaction vessel was purged with dried nitrogen gas. Titanium tetrabutoxide (0.1 parts by mass) was added, and the reaction system was stirred for 8 hours at 180° C. under a nitrogen gas stream for polymerization reaction. Titanium tetrabutoxide (0.2 parts by mass) was further added and the reaction system was stirred for 6 hours at 220° C. The reaction vessel was depressurized to 1333.22 Pa and the reaction was continued under the reduced pressure to give transparent pale yellow amorphous resin 1 (amorphous polyester resin). Amorphous resin 1 had a glass transition point (Tg) of 59° C., a softening point of 101° C., and a weight-average molecular weight (Mw) of 17000.

<Synthesis of Crystalline Polyester Resin 1>

Into a reaction vessel equipped with an agitator, a thermometer, a condenser, and a nitrogen gas inlet were introduced 1,10-dodecanedioic acid (330 parts by mass) and 1,9-nonanediol (230 parts by mass), and the reaction vessel was purged with dried nitrogen gas. Titanium tetrabutoxide (0.1 parts by mass) was added and the reaction system was stirred for 8 hours at 180° C. under a nitrogen gas stream for polymerization reaction. Titanium tetrabutoxide (0.2 parts by mass) was further added and the reaction system was stirred for 6 hours at 220° C. The reaction vessel was depressurized to 10 mmHg and the reaction was continued under the reduced pressure to give crystalline polyester resin 1. Crystalline polyester resin 1 had a melting point of 72° C. and a weight-average molecular weight (Mw) of 15000.

(Step of Controlling Particle Diameter)

Amorphous resin 1 (285 parts by mass), crystalline polyester resin 1 (58 parts by mass), titanium oxide 1 (103.5 parts by mass), and a release agent, Fischer-Tropsch wax "FNP-0090" (70 parts by mass) were kneaded at 120° C. in a biaxial extruder. After the kneading, the mixture was cooled to 25° C.

The mixture was preliminarily pulverized with a hammer mill, was roughly pulverized with a turbo mill (Freund-Turbo Corporation), and further finish-pulverized with an air classifier utilizing the Coanda effect into white matrix particles with a volume median diameter of 7.20 μm.

(Step of Controlling Circularity)

The matrix particles were added to a solution of polyoxyethylene lauryl ether sodium sulfate (5 parts by mass) in deionized water (500 parts by mass), and the dispersion was kept at 80° C. for 3.5 hours. When the circularity became 0.932, the system was cooled. After repeated filtration and washing steps, the cake was dried into toner particles.

Hydrophobic silica (number average primary particle diameter=12 nm, hydrophobicity=68) (1 mass %) and hydrophobic titanium oxide (number average primary particle diameter=20 nm, hydrophobicity=63) (1 mass %) were added to the resulting toner, and were mixed in a "Henschel mixer" (NIPPON COKE & ENGINEERING CO., LTD.). Coarse particles were eliminated with a screen with an opening of 45 μm to give white toner 1 having a volume average median diameter of 7.16 μm and an average circularity of 0.932.

[Preparation of Toners 2 to 7]

Toners 2 to 7 were prepared as in toner 1 except that, in the step of controlling circularity, titanium oxide 1 (103.5 parts by mass) was replaced with titanium oxide A and titanium oxide B in a ratio (mass %) described in Table 2. It is noted that titanium oxide A represents acicular titanium oxide whereas titanium oxide B represents spherical titanium oxide. The term "titanium oxide A, content in toner" indicates the content of acicular titanium oxide for 100 mass % of toner not containing external additive.

[Preparation of Toner 11]

(Preparation of Dispersion of Nanoparticles of Amorphous Resin 1)

Amorphous resin 1 (200 parts by mass) was dissolved in ethyl acetate (200 parts by mass), and the solution was mixed with a solution of polyoxyethylene lauryl ether sodium sulfate (1 mass %) in deionized water (800 parts by mass). The resin was dispersed with an ultrasonic homogenizer. After ethyl acetate was removed from the dispersion under reduced pressure, the solid content was adjusted to 20 mass %. Dispersion of nanoparticles of amorphous resin 1 was thereby prepared. Nanoparticles of amorphous resin 1 have a volume average particle diameter (Mv) of 220 nm.

(Preparation of Nanoparticles of Crystalline Polyester Resin 1)

Crystalline polyester resin 1 (200 parts by mass) was dissolved in ethyl acetate (200 parts by mass) at 70° C., and was mixed with a solution of polyoxyethylene lauryl ether sodium sulfate (1 mass %) in deionized water (800 parts by mass). The resin was dispersed with an ultrasonic homogenizer. Ethyl acetate was removed from the solution under reduced pressure, and the solid content was adjusted to 20 mass %. Dispersion of nanoparticles of crystalline polyester resin 1 was thereby prepared. The nanoparticles of crystalline polyester resin 1 had a volume average particle diameter (Mv) of 220 nm.

(Preparation of Colorant Nanoparticles Dispersion (White))

Titanium oxide 1 (315 parts by mass) was placed into a solution of sodium alkyl diphenyl ether disulfonate (1 mass % (aqueous surfactant solution 100 mass %) in deionized water (480 parts by mass) and was dispersed with an ultrasonic homogenizer. The solid content was adjusted to 30 mass %. The colorant nanoparticles had a volume average particle diameter (Mv) of 200 nm.

(Preparation of Dispersion of Release Agent Nanoparticles)

A release agent, Fischer-Tropsch wax "FNP-0090" (melting point: 89° C., Nippon seiro Co. Ltd.) (200 parts by mass) was melted at 95° C. The melt was added dropwise into a solution of sodium alkyl diphenyl ether disulfonate (3 mass %) (100 mass % aqueous surfactant solution) in deionized water (800 parts by mass), and dispersed with an ultrasonic homogenizer. The solid content was adjusted to 20 mass %. Aqueous dispersion 1 of release agent nanoparticles was thereby prepared.

The volume average diameter (Mv) of release agent nanoparticles in dispersion 1 of release agent nanoparticles determined with a Microtrac particle size analyzer "UPA-150" (Nikkiso Co., Ltd.) was 180 nm.

(Step of Coagulation and Fusion)

Dispersion of nanoparticles of amorphous resin 1 (395 parts by mass), dispersion of nanoparticles of crystalline polyester resin 1 (80 parts by mass), dispersion of release agent nanoparticles (97 parts by mass), dispersion of colorant nanoparticles (229 parts by mass), and aqueous polyoxyethylene lauryl ether sodium sulfate solution (0.5 parts by mass) were placed into a reaction vessel equipped with an agitator, a condenser, and a thermometer, and 0.1 N hydrochloric acid was added with stirring into a pH of 2.5. Poly(aluminum chloride) aqueous solution (aqueous 10 mass % solution on an $AlCl_3$ basis) (0.4 parts by mass) was dropwise added over ten minutes, and the solution was heated with stirring from 25° C. at a rate of 0.05° C./min while the diameter of the aggregated particles was measured with a "Multisizer 3" (Beckman Coulter, Inc.). When the volume median diameter of the aggregated particles reached 6.2 μm, the heating was stopped at 75° C., dispersion 2 of nanoparticles of amorphous resin 1 nanoparticles 22.2 parts by mass was added dropwise over one hour at 75° C. After dropwise addition, the pH of the reaction system was adjusted to 8.5 with 0.5N aqueous sodium hydroxide solution to stop the particle growth (volume median diameter: 6.25 μm).

(Step of Controlling Circularity)

Dispersion was heated to and kept at 85° C. When the average circularity measured with a particle analyzer "FPIA-2000" (Sysmex) became 0.942 (retention time at 85° C. was 200 minutes), the dispersion was cooled to room temperature at a rate of 10° C./min.

(Step of Filtration, Washing, and Drying)

The dispersion after the step of controlling the circularity was subjected to repeated filtration and washing steps and then was dried to prepare toner particles.

(Step of Addition of External Additive)

The resulting toner particles were mixed with hydrophobic silica (number average primary particle diameter=12 nm, hydrophobicity=68) (1 mass %) and hydrophobic titanium oxide (number average primary particle diameter=20 nm, hydrophobicity=63) (1 mass %) in a "Henschel mixer" (NIPPON COKE & ENGINEERING CO., LTD.). Coarse particles were removed through a screen with an opening of 45 μm. Toner 11 was thereby produced. Toner 11 had a volume median diameter of 6.05 μm and an average circularity of 0.942.

[Preparation of Toners 12 to 19]

Toners 12 to 19 were prepared as in toner 1 except that, in the step of controlling particle size, titanium oxide 1 (315 parts by mass) was replaced with titanium oxide A and titanium oxide B in a ratio (mass %) described in Table 3. Titanium oxide A represents acicular titanium oxide whereas titanium oxide B represents spherical titanium oxide. The term "titanium oxide A content in toner" indicates the acicular titanium oxide content for 100 mass % of toner not containing external additive.

The number average major axis diameter, the number average minor axis diameter, the BET specific surface area, and the average aspect ratio of each of titanium oxide 1 to titanium oxide 9 were determined. The results are shown in Table 1.

The average aspect ratio was determined as follows: A photograph at a magnification of 2,000 of titanium oxide was taken with a scanning electron microscope (SEM) "JSM-7401F" (JEOL) and read with a scanner. The photographic image was binarized with an image analyzer "LUZEX® AP" (NIRECO). The average aspect ratio was calculated from 30 particles of titanium oxide selected at random.

The BET specific surface area was determined with a specific surface area analyzer "GEMINI2390" (SHIMADZU Corporation).

The toners prepared by the method described above are characterized as follows:

<Determination and Calculation>

1. Diameter of Toner Particles

The diameter of the toner particles was determined with a Coulter counter "Multisizer 3" (Beckman Coulter, Inc.) connected with a computer system (Beckman Coulter, Inc.) loaded with data processing software (v3.51).

Toner (0.02 g) was wetted in a surfactant solution (20 mL) for dispersion of the toner. The surfactant solution was, for example, a detergent (containing surfactants) diluted ten times with ion-exchanged water, e.g., "Contaminat N" (a 10 mass % aqueous solution of neutral detergent for washing a precision measuring device, having pH 7, and composed of a nonionic surfactant, an anion surfactant, and an organic builder, (Wako Pure Chemical Industries, Ltd.)). The toner particles were ultrasonicated for one minute to prepare toner dispersion. The toner dispersion was injected into a beaker containing "ISOTON® II diluent" (Beckman Coulter, Inc.) in a sample stand of the analyzer with a pipette until the displayed concentration of the analyzer reaches 5 to 10%. Such a range of concentration was able to achieve measurement with high reproducibility. In the analyzer, 25000 particles were counted at an aperture diameter of 100 μm, the range of 2.0 to 60 μm was divided into 256 subranges, and the number of particles in each subrange was determined. Among the volume-based distribution, the 50% particle size from the maximum subranges was defined as a volume median diameter (volume D50% diameter).

The diameter of the toner particles was rounded off to two decimal places.

2. Average Circularity of Toner

The average circularity of the toner was determined with a particle analyzer "FPIA-2000" (Sysmex).

In detail, toner (0.1 g) was wetted in a surfactant solution (50 mL) ("Contaminon N": a 10 mass % aqueous solution of neutral detergent for washing a precision measuring device, having pH 7, and composed of a nonionic surfactant, an anion surfactant, and an organic builder, (Wako Pure Chemical Industries, Ltd.)), and was ultrasonicated for one minute to prepare toner dispersion. The dispersion was subjected to measurement of circularity of the toners with an "FPIA-2100" analyzer. The measurement was carried out under a proper concentration such that 3000 to 10000 particles were detected in a high power field (HPF) (high magnification photographing) mode. Such a range of concentration was able to achieve measurement with high reproducibility. The sheath fluid was particle sheath "PSE-900A" (Sysmex).

The average circularity was calculated from the sum of the circularities of measured particles divided by the number of the measured particles, where the circularity of each particle was defined as follows:

Circularity=(perimeter of a circle having the same projected area as that of a particle)/(perimeter of projected image of the particle)

The average circularity of the toner was rounded off to three decimal places.

3. Endothermic Peak Temperature (Melting Point Tm) of Crystalline Polyester Resin and Glass Transition Temperature (Tg) of Amorphous Resin The endothermic peak temperature of the crystalline polyester resin and the glass transition temperature (Tg) of the amorphous resin were determined in accordance with ASTM D3418 with a differential scanning calorimeter DSC-60A (Shimadzu Corporation). The temperature of the detector of the calorimeter (DSC-60A) was calibrated by the melting points of indium and zinc, and the quantity of heat was calibrated by the heat of fusion of indium. The sample was packed into an aluminum pan and a reference was an empty pan. The temperature program involved heating at a heating rate of 10° C./min, holding at 200° C. for 5 minutes, cooling from 200° C. to 0° C. at a rate of −10° C./min using liquefied nitrogen, holding at 0° C. for 5 min., and then reheating from 0° C. to 200° C. at 10° C./min. The endothermic curve during the second heating step was analyzed. The onset temperature was defined as Tg for the amorphous resin, and the temperature at the maximum of endothermic peak was defined as Tm for the crystalline polyester resin.

4. Volume Average Diameter of Resin Particles, Colorant Particles, and Release Agent The volume average diameter of the resin particles, colorant particles, and release agent was determined by dynamic light scattering with a Microtrac particles-size distribution analyzer UPA-150 (Nikkiso Co., Ltd.).

[Evaluation]

In order to evaluate the masking rate of white toner, toners 1 to 7 and 11 to 19 are each printed over an image formed of magenta toner.

In detail, a commercially available full-color printer "bizhub PRO C6500" (Konica Minolta) was converted such that the surface temperature of a fixing heat roll of the fixing device was able to be varied within the range of 100 to 210° C. and a white fixing image was outputted on a magenta toner image. A magenta image was formed with magenta toner for "bizhub PRO C6500" as a developer on plain paper of a grammage of 80 g and then a solid patch of 2 cm by 2 cm of each of toners 1 to 7 and 11 to 19 was printed at a density of 0.4 g/m$^2$ on the magenta toner image and was fixed at 180° C. The resulting image was observed as a white image that masked the underling magenta image. The magenta concentration of the solid patch was measured with a Mackbeth optical densitometer to evaluate the masking rate. A higher masking rate of the white toner leads to a lower magenta concentration.

The results are shown in Tables 2 and 3. In view of visual evaluation, the acceptable level was determined to be a magenta concentration of 0.15 or less. Both pulverized toners (toners 1 to 7) and polymerized toners (toners 11 to 19) exhibited sufficiently high masking effects within the inventive range.

TABLE 1

| Used titanium oxide | | | | | | | |
|---|---|---|---|---|---|---|---|
| Titanium oxide No. | Shape | A number average major axis diameter [μm] | A number average minor axis diameter [μm] | BET specific surface area | Average aspect ratio | Crystal structure | Remarks |
| Titanium oxide 1 | Spherical | — | — | 7 | 1 | Rutile | Comparative example |
| Titanium oxide 2 | Acicular | 1.68 | 0.13 | 15 | 13 | Rutile | Present invention |
| Titanium oxide 3 | Acicular | 2.86 | 0.21 | 13 | 14 | Rutile | Present invention |
| Titanium oxide 4 | Acicular | 5.15 | 0.27 | 5 | 19 | Rutile | Present invention |
| Titanium oxide 5 | Acicular | 0.075 | 0.055 | 70 | 1.4 | Rutile | Comparative example |
| Titanium oxide 6 | Acicular | 0.5 | 0.2 | 50 | 2.5 | Rutile | Comparative example |
| Titanium oxide 7 | Acicular | 8 | 0.2 | 2 | 40 | Rutile | Comparative example |
| Titanium oxide 8 | Acicular | 3 | 0.2 | 13 | 3 | Rutile | Present invention |
| Titanium oxide 9 | Acicular | 3 | 0.2 | 13 | 30 | Rutile | Present invention |

TABLE 2

| Pulverized toners | | | | | | | | |
|---|---|---|---|---|---|---|---|---|
| Toner No. | Titanium oxide A | Titanium oxide B | Titanium oxide A/(A + B) [mass %] | Titanium oxide A + B parts of pigment [parts by mass] | Titanium oxide A content in toner [mass %] | Density [g/m$^2$] | Magenta concentration | Remarks |
| Toner 1 | (None) | Titanium oxide 1 | 0 | 103.5 | 0 | 0.4 | 0.25 | Comparative example |
| Toner 2 | Titanium oxide 2 | Titanium oxide 1 | 20 | 103.5 | 4.2 | 0.4 | 0.12 | Present invention |
| Toner 3 | Titanium oxide 3 | Titanium oxide 1 | 80 | 103.5 | 16.8 | 0.4 | 0.1 | Present invention |
| Toner 4 | Titanium oxide 4 | Titanium oxide 1 | 40 | 103.5 | 8.4 | 0.4 | 0.13 | Present invention |
| Toner 5 | Titanium oxide 5 | Titanium oxide 1 | 50 | 103.5 | 10.5 | 0.4 | 0.9 | Comparative example |
| Toner 6 | Titanium oxide 6 | Titanium oxide 1 | 50 | 103.5 | 10.5 | 0.4 | 0.24 | Comparative example |
| Toner 7 | Titanium oxide 7 | Titanium oxide 1 | 90 | 103.5 | 18.9 | 0.4 | 0.25 | Comparative example |

TABLE 3

| Polymerized toners | | | | | | | | |
|---|---|---|---|---|---|---|---|---|
| Toner No. | Titanium oxide A | Titanium oxide B | Titanium oxide A/(A + B) [mass %] | Titanium oxide A + B parts of pigment [parts by mass] | Titanium oxide A content in toner [mass %] | Density [g/m$^2$] | Magenta concentration | Remarks |
| Toner 11 | (None) | Titanium oxide 1 | 0 | 315 | 0 | 0.4 | 0.27 | Comparative example |
| Toner 12 | Titanium oxide 2 | Titanium oxide 1 | 40 | 315 | 11.6 | 0.4 | 0.13 | Present invention |
| Toner 13 | Titanium oxide 3 | Titanium oxide 1 | 60 | 315 | 17.4 | 0.4 | 0.09 | Present invention |
| Toner 14 | Titanium oxide 4 | Titanium oxide 1 | 90 | 315 | 26.1 | 0.4 | 0.14 | Present invention |
| Toner 15 | Titanium oxide 5 | Titanium oxide 1 | 50 | 315 | 14.5 | 0.4 | 0.95 | Comparative example |
| Toner 16 | Titanium oxide 6 | Titanium oxide 1 | 50 | 315 | 14.5 | 0.4 | 0.21 | Comparative example |
| Toner 17 | Titanium oxide 7 | Titanium oxide 1 | 75 | 315 | 21.8 | 0.4 | 0.31 | Comparative example |
| Toner 18 | Titanium oxide 8 | Titanium oxide 1 | 90 | 315 | 26.1 | 0.4 | 0.13 | Present invention |
| Toner 19 | Titanium oxide 9 | Titanium oxide 1 | 90 | 315 | 26.1 | 0.4 | 0.14 | Present invention |

Although embodiments of the present invention have been described and illustrated in detail, it is clearly understood that the same is by way of illustration and example only and not limitation, the scope of the present invention should be interpreted by terms of the appended claims.

What is claimed is:

1. An electrostatic charge image developing toner comprising a white pigment consisting of acicular titanium oxide having an average aspect ratio within a range of 3 to 30, wherein a content of the acicular titanium oxide having the average aspect ratio within the range of 3 to 30 is within a range of 10 to 40 mass % of the toner, and wherein the toner is a white toner.

2. The electrostatic charge image developing toner of claim 1, wherein the acicular titanium oxide has a number average major axis diameter within a range of 1 to 7 μm.

3. The electrostatic charge image developing toner of claim 1, wherein the content of the acicular titanium oxide having the average aspect ratio within the range of 3 to 30 is within a range of 5 to 100 mass % of a total amount of titanium oxide.

4. The electrostatic charge image developing toner of claim 1, wherein the acicular titanium oxide has a BET specific surface area in a range of 3 to 50 m$^2$/g.

5. The electrostatic charge image developing toner of claim 1, wherein the acicular titanium oxide has a rutile crystal structure.

6. The electrostatic charge image developing toner of claim 1, wherein the average aspect ratio is within a range of 8 to 25.

7. The electrostatic charge image developing toner of claim 1, wherein the acicular titanium oxide has a number average major axis diameter within a range of 2 to 4 μm.

8. The electrostatic charge image developing toner of claim 1, wherein the acicular titanium oxide has a number average minor axis diameter within a range of 0.001 to 1 μm.

9. The electrostatic charge image developing toner of claim 1, wherein the acicular titanium oxide has a number average minor axis diameter within a range of 0.01 to 3 μm.

10. The electrostatic charge image developing toner of claim 1, wherein the content of the acicular titanium oxide having the average aspect ratio within the range of 3 to 30 is within a range of 30 to 100 mass % of a total amount of titanium oxide.

11. The electrostatic charge image developing toner of claim 1, wherein the acicular titanium oxide has a BET specific surface area in a range of 8 to 30 m$^2$/g.

12. The electrostatic charge image developing toner of claim 1, wherein the content of the acicular titanium oxide is within a range of 20 to 30 mass % of the toner.

13. An electrostatic charge image developing toner comprising a white pigment being acicular titanium oxide having an average aspect ratio within a range of 3 to 30, wherein a content of the acicular titanium oxide having the average aspect ratio within the range of 3 to 30 is within a range of 20 to 40 mass % of the toner, and wherein the toner is a white toner.

14. The electrostatic charge image developing toner of claim 13, wherein the acicular titanium oxide has a number average major axis diameter within a range of 1 to 7 μm.

15. The electrostatic charge image developing toner of claim 13, wherein the acicular titanium oxide has a BET specific surface area in a range of 3 to 50 m$^2$/g.

16. The electrostatic charge image developing toner of claim 13, wherein the acicular titanium oxide has a rutile crystal structure.

17. The electrostatic charge image developing toner of claim 13, wherein the average aspect ratio is within a range of 8 to 25.

18. The electrostatic charge image developing toner of claim 13, wherein the acicular titanium oxide has a number average major axis diameter within a range of 2 to 4 μm.

19. The electrostatic charge image developing toner of claim 13, wherein the acicular titanium oxide has a number average minor axis diameter within a range of 0.001 to 1 μm.

20. The electrostatic charge image developing toner of claim 13, wherein the acicular titanium oxide has a number average minor axis diameter within a range of 0.01 to 3 μm.

* * * * *